US005308000A

United States Patent [19]

Riley

[11] Patent Number: 5,308,000

[45] Date of Patent: May 3, 1994

[54] WATER SAVER CONTROL FOR DISPOSERS

[75] Inventor: Wayne C. Riley, Sturtevant, Wis.

[73] Assignee: Emerson Electric Co., Inc., Racine, Wis.

[21] Appl. No.: 45,045

[22] Filed: Apr. 8, 1993

[51] Int. Cl.[5] ..... B02C 25/00

[52] U.S. Cl. ..... 241/33; 241/35; 241/46.013

[58] Field of Search ..... 241/15, 33-36, 241/46.013, 46.014, 46.015, 46.016

[56] References Cited

U.S. PATENT DOCUMENTS

| | | | |
|---|---|---|---|
| 2,785,863 | 3/1957 | Jordan . | |
| 2,876,953 | 3/1959 | Shepherd . | |
| 2,876,954 | 3/1959 | Shepherd . | |
| 2,880,941 | 4/1959 | Fox et al. . | |
| 2,918,222 | 12/1959 | Shepherd . | |
| 3,034,734 | 5/1962 | Guth . | |
| 3,335,969 | 8/1967 | Egle . | |
| 3,344,996 | 10/1967 | Meyers . | |
| 3,510,069 | 5/1970 | Hannum . | |
| 3,545,684 | 12/1970 | Ruspino et al. . | |
| 4,074,422 | 2/1977 | Färber et al. | 241/33 X |
| 4,373,676 | 2/1983 | Sherman | 241/46.013 |
| 4,776,523 | 10/1988 | Hurst . | |

*Primary Examiner*—Douglas D. Watts
*Attorney, Agent, or Firm*—Ryan, Kees & Hohenfeldt

[57] ABSTRACT

A waste disposer having a rotatable shredding element for grinding waste in a flushing liquid, an outlet for discharging ground waste material in liquid to a drain, an electrically-powered motor for driving the rotatable shredding element and a source for supplying flushing liquid the disposer that includes a detector for sensing the amount of electrical current flowing to the motor. The system includes, at least, one valve for controlling the flow of flushing liquid to the disposer which valve is controlled by means of a controller that is responsive to the electrical current detector. The controller increases the amount of flushing liquid falling into the disposer in response to a detected increase in the amount of electrical current flowing into the motor. The invention optionally includes a second valve for controlling flushing liquid to the disposer at a lower rate, which second valve is opened whenever the electrical is activated. Both of the controllers may be solenoids, but the first-mentioned controller may also be a progressively activated servo motor that progressively increases the flow of water to the disposer as the electrical current usage increases.

7 Claims, 1 Drawing Sheet

WATER SAVER CONTROL FOR DISPOSERS

FIELD OF THE INVENTION

This invention relates to a system for controlling water usage in a waste or garbage disposer More particularly, the invention relates to such a system that enables water conservation by controlling the flow of water through the disposer in response to the measurement of the grind load.

BACKGROUND OF THE INVENTION

In commercial garbage disposers used, for example, in business establishments such as restaurants, the usage of water is high because water flow levels must be set for the maximum grind rate in order to prevent drain blockage Attendants will turn on the disposer and water at a high flow rate and allow both to run continuously even though the unit is grinding at a low rate or running idle Various controls for garbage grinders have heretofore been proposed. For example, U.S. Pat. No. 2,785,863 discloses the use of a time delay relay to operate a solenoid valve, which delays shutoff of water for a brief time after the motor is turned off. In accordance with another suggestion, water can be kept flowing as long as the motor is spinning in order to prevent dry grinding while the motor is coasting during shutoff. See, for example, U.S. Pat. No. 2,880,941. It has also been proposed to monitor conductivity between the rotating and stationary elements as suggested in U.S. Pat. No. 3,344,996. However, the rotating and stationary shredders must, then, be electrically insulated. A still further suggestion has been to monitor noise level vibration, or flow, through an outlet so that the disposer is automatically shut off when it is finished grinding See U.S. Pat. No. 3,545,684. A need has continued to exist, however, for an approved system for ensuring that adequate water is provided to a disposer, but also that water is not wasted.

SUMMARY OF THE INVENTION

It is an object of the present invention to provide a grinder wherein the water flow through the grinder varies directly with the grinding load. In accordance with an aspect of the invention water flow to a grinder is controlled by a sensing of the grind load. In accordance with a related aspect, the optimum rate of water flow is provided for a particular load, and means are provided to increase and decrease the water flow as the load increases or decreases. In accord with a further related aspect of the invention, a current sensor is used to monitor current flow to a grind motor in order to provide a signal that triggers an increased flow of water to the grinder.

In accordance with a further aspect of the invention, a control system for a disposer is provided that uses a current sensor and two electrically operated solenoids to control two separate water control valves. One of the solenoids controls the flow of water through a low flow restricter, while the other solenoid controls the flow of water through a high flow restrictor. The first solenoid activates the lower flow of water when the disposer motor is turned on. Thus a slow flowing stream of water flows through the disposer at all times that the motor is operating. A continuing low flow is necessary to wash through small amounts of materials that do not create enough motor load to cause the sensor to open the high flow restricter. Thus opening of the low flow water control valve provides for grinding and flushing of light loads. The second solenoid responds to a signal from the motor current sensor indicating that a grind load has been encountered and triggers the solenoid to cause a higher water flow. In accordance with yet another aspect of the invention, the current sensing module is provided with a delay feature so that when high current occurs, the solenoid is actuated, and after the high grind current is discontinued, a delay causes the sensor to produce a signal to the solenoid for a short period of time, so that the higher flow of water continues for a brief period after the grinding has been finished.

Briefly summarized, the present invention provides a waste disposer having a rotatable shredding element driven by an electric motor for grinding waste in a flushing liquid, usually water. An outlet is provided for discharging liquid and ground waste material to a drain. The source, pipes or conduits, for supplying flushing liquid is controlled by appropriate valves, including at least one valve operated by means of a controller that is responsive to an electrical current detector that senses the amount of electrical current flowing to the motor. The controller increases the amount of flushing liquid flowing into the disposer in response to a detected increase in the amount of electrical current drawn by the motor. The preferred embodiment of the invention also includes a second valve for controlling flushing liquid to the disposer at a lower rate, which second valve is opened whenever the electrical motor is activated. Both of the controllers may be solenoids, but the first-mentioned controller may also be a progressively activated servo motor that progressively increases the flow of water to the disposer as the electrical current usage increases. In accordance with this embodiment, the water flow can be increased in direct proportion to the increase in waste load as indicated by a detected increase in electrical current usage. If desired, the system can be provided with a delay feature such that the higher rate of water flow continues for a brief period of time after the grind load to the motor ceases. In accordance with yet another alternative embodiment, a greater number of solenoids could be used. For example, three solenoids could be used to give low, medium and high rates of water flow.

The invention will be set forth in greater detail in the following detailed description and accompanying drawings.

DRAWINGS

DETAILED DESCRIPTION

Figure 1:
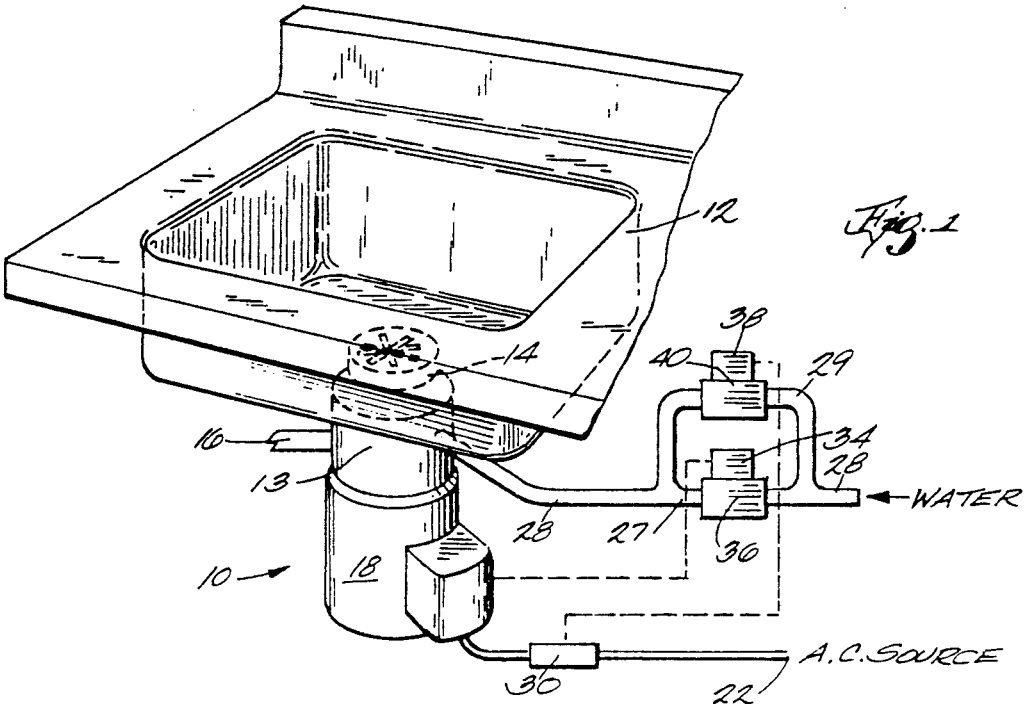
FIG. 1 is an illustration of the invention shown partly in perspective with hidden parts illustrated by phantom lines and partly by means of a schematic drawing.

Referring to the drawings, there is seen in FIG. 1 a commercial garbage disposer 10 of conventional design. Disposer 10 is connected in conventional fashion to a drain opening 14 of a sink 12. An outlet conduit 16 is connected to a sanitary sewer system. Disposer 10 includes an upper grind section 13 and an electrical motor 18.

Motor 18 is connected to an AC power source 22. The flow of electrical current through motor windings 20 is controlled by a switch 23. Electrical lead wires 24 and 26 are, thus, energized when switch 23 is closed. Conduit 28 which includes parallel branches 27 and 29 is connected to a source of flushing water that is discharged into grind chamber 13.

Figure 2:
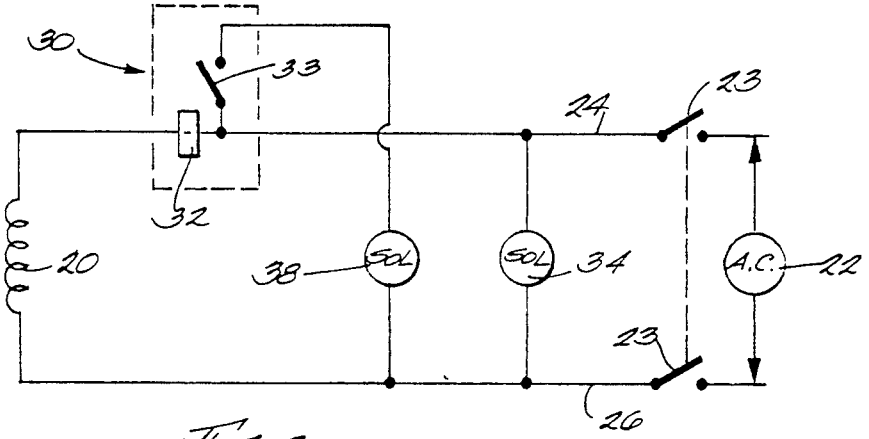
FIG. 2 is an electrical schematic drawing showing one embodiment of the invention.

Referring to FIG. 2, a schematically illustrated current sensor 30 is provided to sense the flow of current through winding 20 and hence through lead 24. In the illustrated embodiment, a toroid 32 is shown as an example of an induction operated device that responds to the flow of current through lead 24 and causes a switch 33 to be closed whenever a grind load is placed in disposer 10. It will be further noted in FIG. 2 that when switch 23 is closed, a first solenoid 34 is energized and causes opening of a valve 36 allowing water to flow at a low rate through conduit 27 and into grind chamber 13. It will be apparent that solenoid 34 is, thus, activated whenever there is power provided to motor winding 20. Valve 36 is preferably designed so that approximately one to two gallons per minute of water will flow through conduit 27.

When a grind load is encountered by the passage of material from sink 12 in through grinder 10, the increased current flow through winding 20 is sensed by current sensor 30. Current sensor 30 causes a second solenoid 38 to open valve 40 allowing water to flow through conduit 29. Valve 40 and conduit 29 are configured so that water will flow at a relatively higher rate, preferably in the range of about 3 to 7 gallons per minute. When the load grind has discontinued the flow of current through winding 20 diminishes to the point that switch 33 is once again opened due to a drop in the current induced in toroid 32. This causes valve 40 to once again be closed thereby conserving water when no grind load is experienced. A time delay can be designed into the circuitry so that valve 40 will not be closed until there has been no grind load detected for a selected period of time, for example 10 seconds. This will help ensure the thorough flushing of ground materials out of outlet 16.

Figure 3:
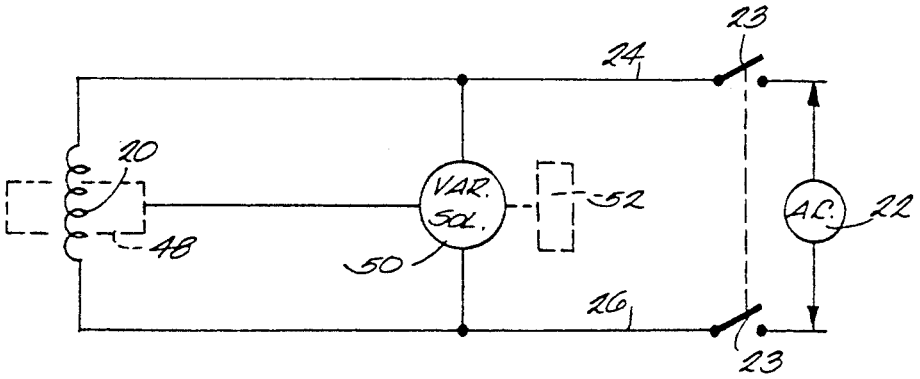
FIG. 3 is an electrical schematic drawing showing a further embodiment of the invention.

In the further embodiment of FIG. 3, a current detector 48 is connected to a variable solenoid 50 that will progressively increase the opening of a valve 52 in response to the amount of current flowing through motor windings 20. With this arrangement, sensor 48 can be utilized to trigger a low rate of flow in the one to two gallon range through conduit 28 when switch 23 is closed. As increased amounts of current flow through winding 20 variable solenoid 50 can be set to allow progressively increasing amounts of water to flow through conduit 28 into the grind chamber 13.

Current sensors 30 and 48 can be of various types. Preferably an induction operated device is used such as a current transformer, watt meter, or if desired, an ammeter. A preferred type of sensor is marketed by Solid State Advance Controls, Inc. as an "alternating current sensor" and is provided with adjustable sensitivity. As previously noted, a number of solenoids greater than two can be utilized. Thus, for example, if low, medium and high rates of water flow are desired, three solenoids are used instead of two.

While solenoid operated control valves have been shown for purposes of illustration, it will be understood that other types of valves could be substituted For example, pneumatically or hydraulically controlled valves can be used if desired.

While specific embodiments of the invention have been shown for purposes of illustration, it will be apparent that further modifications can be made. Therefore, the scope of the invention should be determined with reference to the appended claims.

What is claimed is:

1. A waste disposer having a rotatable shredding element for grinding waste in a flushing liquid, an outlet for discharging ground waste material and liquid to a drain, an electrically powered motor for driving said rotatable shredding element and a conduit for supplying flushing liquid to said disposer comprising:

a detector for sensing the amount of electrical current flowing to said motor, at least one valve controlling the flow through said conduit, and a controller responsive to said detector for controlling said valve to increase the amount of liquid flowing through said conduit in response to a detected increase in the amount of said electrical current.

2. A waste disposer according to claim 1 wherein said controller comprises a solenoid.

3. A waste disposer according to claim 1 comprising a second valve is provided on said conduit in parallel with said one valve, and a switch for turning the supply of electricity to said motor on and off, and a second controller responsive to said switch to open said second valve when said supply of electricity is turned on and to close said second valve when said supply of electricity is turned off.

4. A waste disposer according to claim 3 wherein said second controller comprises a solenoid.

5. A waste disposer according to claim 3 wherein said first controller is a progressive servo motor.

6. A waste disposer having a rotatable shredding element for grinding waste in a flushing liquid, an outlet for discharging ground waste material and liquid to a drain, an electrically powered motor for driving said rotatable shredding element and a conduit for supplying flushing liquid to said disposer comprising:

a detector for sensing the amount of electrical current flowing to said motor, at least two valves controlling the flow of flushing liquid into said conduit, and a solenoid responsive to said detector for controlling at least one of said valves to increase the amount of liquid flowing through said conduit in response to a detected increase in the amount of said electrical current.

7. A waste disposer according to claim 6 wherein said valves are located in parallel branches of said conduit, and one of said solenoids is controlled by a switch for turning the supply of electricity to said motor on and off, and a second one of said solenoids is responsive to said detector.

* * * * *